US006526248B1

(12) United States Patent
Aoki et al.

(10) Patent No.: US 6,526,248 B1
(45) Date of Patent: Feb. 25, 2003

(54) TONER SUPPORT MEMBER AND DEVELOPING DEVICE PREVENTED FROM CHARGING TONER BY FRICTION

(75) Inventors: Katsuhiro Aoki, Kanagawa (JP); Takashi Hodoshima, Kanagawa (JP); Hajime Oyama, Chiba (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 09/662,550

(22) Filed: Sep. 15, 2000

(30) Foreign Application Priority Data

Sep. 16, 1999 (JP) ..... 11-261697

(51) Int. Cl.[7] ..... G03G 15/08
(52) U.S. Cl. ..... 399/286; 399/282
(58) Field of Search ..... 399/272, 276, 399/281, 282, 286

(56) References Cited

U.S. PATENT DOCUMENTS

| | | | | |
|---|---|---|---|---|
| 3,929,098 | A | * 12/1975 | Liebman | 399/282 |
| 5,339,141 | A | 8/1994 | Suzuki et al. | |
| 5,341,196 | A | 8/1994 | Hodoshima et al. | |
| 5,424,814 | A | 6/1995 | Suzuki et al. | |
| 5,450,177 | A | 9/1995 | Oyama | |
| 5,489,747 | A | * 2/1996 | Takenaka et al. | 399/272 |
| 5,565,973 | A | 10/1996 | Fujishiro et al. | |
| 5,655,193 | A | 8/1997 | Fujishiro et al. | |
| 5,659,860 | A | 8/1997 | Sasaki et al. | |
| 5,771,426 | A | 6/1998 | Oka et al. | |
| 5,805,965 | A | 9/1998 | Tsuda et al. | |
| 5,822,664 | A | 10/1998 | Oka et al. | |
| 5,864,733 | A | 1/1999 | Mae et al. | |
| 6,163,669 | A | * 12/2000 | Aoki et al. | 399/286 X |
| 6,295,437 | B1 | 9/2001 | Hodoshima et al. | |
| 6,366,751 | B1 | 4/2002 | Shakuto et al. | |
| 6,385,423 | B1 | 5/2002 | Kai | |
| 6,442,364 | B2 | 8/2002 | Kai et al. | |
| 6,449,452 | B1 | 9/2002 | Kai | |
| 6,456,806 | B2 | 9/2002 | Shoji et al. | |
| 6,463,244 | B2 | * 10/2002 | Aoki et al. | 399/267 |

FOREIGN PATENT DOCUMENTS

| | | | |
|---|---|---|---|
| JP | 5-46009 | | 2/1993 |
| JP | 5-210292 | | 8/1993 |
| JP | 6-161226 | | 6/1994 |
| JP | 7-209921 | * | 8/1995 |
| JP | 8-190263 | * | 7/1996 |
| JP | 10-93117 | * | 3/1998 |
| JP | 10-311328 | * | 11/1998 |
| JP | 11-219087 | * | 8/1999 |
| JP | 2000-19835 | | 1/2000 |
| JP | 2000-39763 | | 2/2000 |

* cited by examiner

*Primary Examiner*—Joan Pendegrass
(74) *Attorney, Agent, or Firm*—Oblon, Spivak, McClelland, Maier & Neustadt, P.C.

(57) ABSTRACT

A developing device for an image forming apparatus of the type feeding a one-ingredient or two-ingredient type developer, forming a thin toner layer on a developing roller or toner support member and developing a latent image with the toner layer is disclosed. The toner support member has a surface that is chargeable to the same polarity as toner. The toner support member therefore serves to simply support the toner without electrostatically effecting the toner, so that the development of a latent image is free from the influence of the static electricity of the toner support member. This successfully enhances image quality. A photoconductive element has a coefficient of friction $\mu$ confined in the range of $0.1<\mu<0.4$, preventing the toner from depositing on and contaminating the background area of the element. In addition, the surface of the photoconductive element is protected and has its service life extended. Further, the toner support member has a hardness HS lying in the range of $10° \leqq HS \leqq 45°$, as measured by JIS (Japanese Industrial Standards) A scale, achieving a smooth surface and thereby insuring a uniform developing characteristic. An image forming apparatus including the developing device is also disclosed.

25 Claims, 4 Drawing Sheets

FIG. 3

NUMERAL : ΔID

| DRUM μ | NO PROCESSING 0.57~0.59 | | APPLICATION OF ZINC STEARATE 0.22~0.25 | | SILICONE OIL 0.2 |
|---|---|---|---|---|---|
| (JIS-A) | 40° SD−1 | 20° ← | 40° ← | 20° ← | 40° ← |
| 150(3g/mm) | 0.035 | 0.032 | 0.006 | 0.004 | 0.009 |
| 200(4g/mm) | 0.033 | 0.034 | 0.008 | 0 | 0.165 |
| 300(6g/mm) | | | 0.005 | 0.005 | 0.021 |
| 400(8g/mm) | 0.021 | 0.025 | b 0.008 | 0.005 | 0.013 |
| 500(10g/mm) | | | b | 0.005 | |
| 600(12g/mm) | a 0.024 | a 0.026 | c 0.005 | 0 | 0.007 |
| 700(14g/mm) | | | c 0.009 | b 0 | c 0.146 |
| 800(16g/mm) | | | c | c 0 | c 0.084 |
| 900(18g/mm) | | | c | c 0 | |

TARGET : ΔID<0.02

TONER SUPPORT MEMBER AND DEVELOPING DEVICE PREVENTED FROM CHARGING TONER BY FRICTION

BACKGROUND OF THE INVENTION

The present invention relates to a developing device of the type feeding a one-ingredient or two-ingredient type developer, forming a thin toner layer on a developing roller or toner support member and developing a latent image with the toner layer, and a printer, facsimile apparatus, copier or similar image forming apparatus including the same.

Developing devices of the type described and featuring unique toner supporting systems are disclosed in, e.g., Japanese Patent Laid-Open Publication Nos. 56-40862, 59-151173 and 8-254933. The developing device taught in Laid-Open Publication No. 56-40862 includes a developing roller for supporting toner contained in a two-ingredient type developer. An oscillating electric field is formed between the developing roller and a photoconductive element spaced therefrom for developing a latent image formed on the element. This type of development is generally referred to as non-contact development.

The developing device disclosed in the above Laid-Open Publication No. 59-151173 is similar to the developing device disclosed in Laid-Open Publication No. 56-40862 except that the developing roller includes toner collecting means. The toner collecting means, however, increases the number of parts, unit capacity, and cost.

The developing device proposed in Laid-Open Publication No. 8-254933 includes lubricant applying means for applying a lubricant to a photoconductive element. Toner concentration sensing means is responsive to the concentration of toner deposited on the photoconductive element outside of an image area. Control means controls the lubricant applying means in accordance with the output of the toner concentration sensing means.

On the other hand, in a contact development type of developing device, a developing roller is held in contact with a photoconductive element with the intermediary of a toner layer. Toner is charged by friction acting between it and the developing roller. Assume that the toner is chargeable to negative polarity. Then, if the surface layer of the developing roller is charged to the same polarity as the toner, the toner has its charge noticeably lowered or is charged to the opposite polarity. As a result, the toner fails to sufficiently develop a latent image and contaminates the background of the photoconductive element, thereby degrading image quality to a critical degree.

Technologies relating to the present invention are also disclosed in, e.g., Japanese Patent Laid-Open Publication Nos. 4-372981, 5-46009, 5-210292, 6-161226, 2000-19835 and 2000-39763.

SUMMARY OF THE INVENTION

It is therefore an object of the present invention to provide a developing device capable of preventing a toner support member from charging toner by friction to thereby surely develop a latent image. In accordance with the present invention, in an image forming apparatus for feeding either a one-ingredient type or a two-ingredient type developer and causing only toner to selectively deposit on a toner support member to thereby develop a latent image formed on a photoconductive element, the toner support member has at least a surface layer thereof formed of a material chargeable to the same polarity as the toner. At least the surface layer of the toner support member may contains a fluorine-containing substance.

BRIEF DESCRIPTION OF THE DRAWINGS

The above and other objects, features and advantages of the present invention will become more apparent from the following detailed description taken with the accompanying drawings in which:

FIG. 3 is a table representative of a relation between the contact pressure of a developing roller to act on a photoconductive element and the background contamination of the element and defective image.

DESCRIPTION OF THE PREFERRED EMBODIMENT

Figure 1:
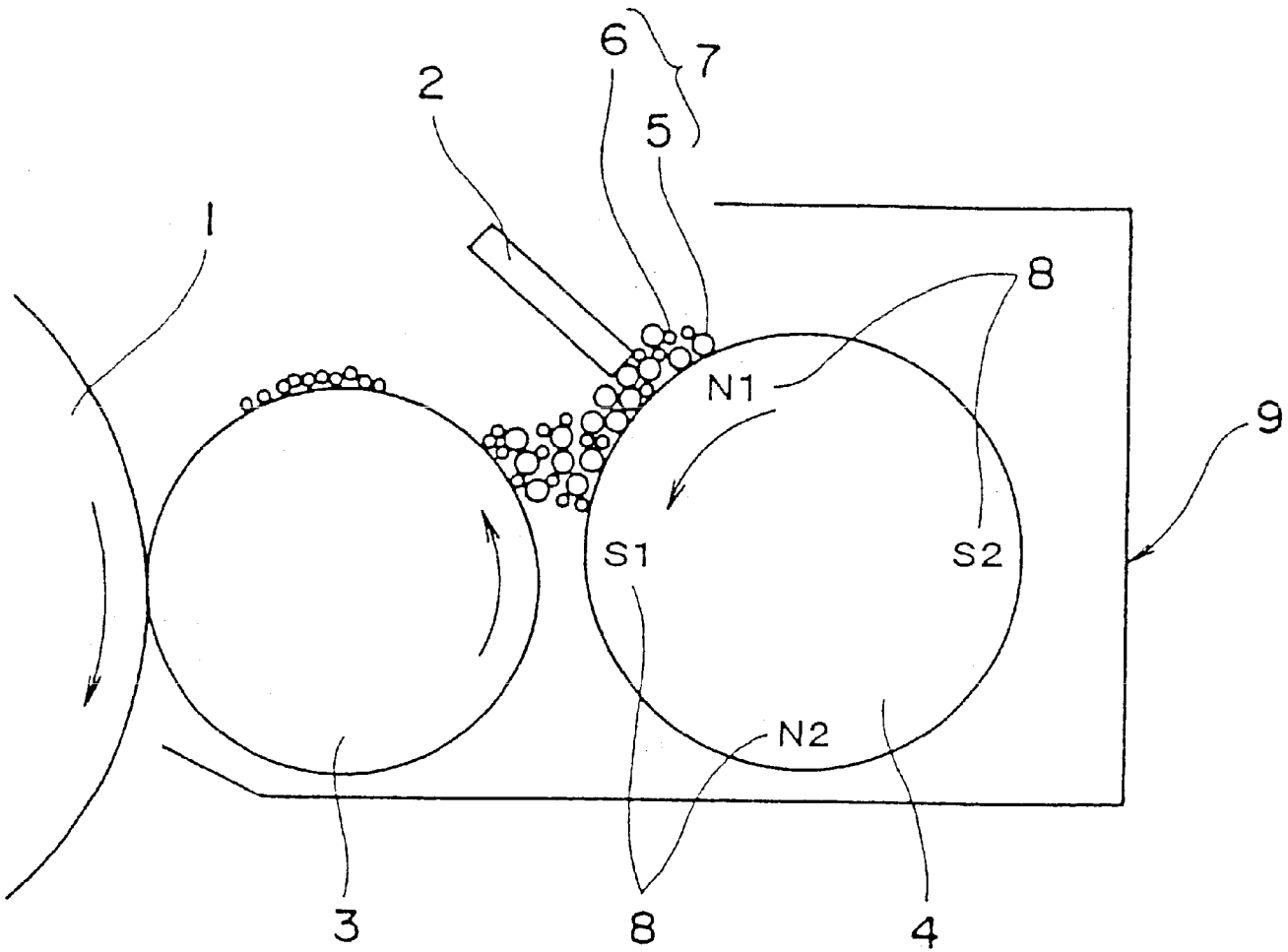
FIG. 1 is a view showing a developing device embodying the present invention and included in an image forming apparatus.

Referring to FIG. 1 of the drawings, a developing device included in an image forming apparatus embodying the present invention is shown. As shown, the image forming apparatus includes an image carrier implemented as a photoconductive drum 1. The developing device includes a casing 9 storing a developer 7 implemented as a mixture of toner particles 6 and magnetic carrier particles 5. The casing 9 accommodates a developing roller or toner support member 3 facing the drum 1, a developer feed member 4, and a doctor blade or regulating member 2. The developer feed member 4 feeds the developer 7 to the developing roller 3 while the doctor blade 2 regulates the amount of the developer 7 to be fed from the developer feed member 4 to the developing roller 3.

The toner 6 is a mixture of polyester, polyol, styrene-acryl resin or similar resin, a charge control agent (CCA), and a coloring agent. Silica, titanium oxide or similar substance is added to the outside of such toner particles in order to enhance fluidity. Usually, the additive has a particle size ranging from 0.1 $\mu$m to 1.5 $\mu$m. The coloring agent may be carbon black, Phthalocyanine Blue, quinacrydone or carmine by way of example. In the illustrative embodiment, the toner 6 is chargeable to negative polarity. The toner 6, to which the above additive is to be applied, may additionally contain, e.g., wax dispersed therein. While the volume mean particle size of the toner 6 should preferably be 3$\mu$m to 12 $\mu$m, it is 7 m in the illustrative embodiment and can sufficiently adapt to resolution as high as 1,200 dpi (dots per inch) or above.

The magnetic carrier particles 5 each have a core formed of metal or resin and contains ferrite or similar magnetic substance. The surface of each carrier particle 5 is covered with, e.g., silicone resin. The carrier particles 5 should preferably have a particle size ranging from 20 $\mu$m to 50 $\mu$m.

The developer feed member 4 is implemented as a nonmagnetic, rotatable sleeve and accommodates a plurality of magnets 8 that are fixed in place. The magnetic forces of the magnets 8 act on the developer 7 when the developer 7 passes preselected positions. In the illustrative embodiment, the sleeve 4 has a diameter of 18 mm and has its surface roughened by sand-blasting to a range of from 10 $\mu$m RZ to 20 $\mu$m RZ.

The magnets 8 have four magnetic poles N1, S1, N2 and S2, as named from the position of the doctor blade 2 in the direction in which the developer feed member 4 is rotatable. The developer 7, i.e., the mixture of toner particles 6 and carrier particles formed by the magnets 8 is deposited on the developer feed member 4. The toner particles 6 and carrier particles 5 are mixed together, so that a preselected amount of charge deposits on the toner particles 6. In the illustrative embodiment, the amount of charge should preferably be −10 $\mu$C/g to −40 $\mu$C/g. In this manner, the developer 7 forms a magnet brush on the developer feed member 4.

The developing roller 3 faces part of the developer feed member 7 where the magnetic pole S1 is positioned, and contacts the magnet brush formed on the member 7. The developing roller 3, contacting the drum 1, develops a latent image electrostatically formed on the drum 1 with the developer 7.

The doctor blade 2 contacts the developer or magnet brush 7 deposited on the developer feed member 4 at a position where the developing roller 3 and member 4 face each other. The drum 1, developing roller 3 and developer feed member 4 each are rotatable in a particular direction indicated by an arrow in FIG. 1.

Generally, the drum 1 is made up of a core formed of aluminum or similar metal and a photoconductive layer formed on the core by applying an organic photoconductive to the core. Alternatively, the drum 1 may be replaced with a photoconductive belt consisting of a relatively thin polyethylene terephthalate (PET), polyethylene naphthalate (PEN), nickel substrate and a photoconductive layer formed thereon.

In operation, the developer feed member 4 agitates the developer 7 in cooperation with a rotatable agitator, not shown, and magnets 8. As a result, the toner particles 6 and carrier particles 5 are charged by friction while being mixed together. The doctor blade 2 regulates the amount of the developer 7 to deposit on the developer feed member 4. Consequently, the developer 7 is transferred from the developer feed member 4 to the developing roller 3 in a preselected amount under the action of, e.g., a bias voltage. The rest of the developer 7 is returned to the casing 9.

In the illustrative embodiment, the minimum distance between the doctor blade 2 and the developer feed member 4 is 500 $\mu$m. In addition, the magnetic pole N1 adjoining the doctor blade 2 is shifted from the doctor blade 2 by a small angle θ to the upstream side in the direction of rotation of the developer feed member 4. The developer 7 can therefore easily move in the form of a circulating flow.

The toner 6 deposited on the developing roller 3 is transferred to the drum 1 by a bias applied to the roller 3, i.e., develops a latent image formed on the drum 1 to thereby form a corresponding toner image. In the illustrative embodiment, the drum 1 and developing roller 3 rotate at linear velocities of 200 mm/sec and 300 mm/sec, respectively.

In the illustrative embodiment, the drum 1 is assumed to include a rigid core implemented by an aluminum tube. The developing roller 3 should therefore preferably be formed of rubber and provided with hardness ranging from 10 HS to 70 HS, as measured in accordance with JIS (Japanese Industrial Standards) scale A. The developing roller 3 has a diameter of 10 mm to 30 mm and has its surface roughened to 1 $\mu$m Rz to 4 $\mu$m Rz (ten-point mean roughness). This roughness is 13% to 80% of the volume mean particle size of the toner 6 and allows the toner 6 to be conveyed without being buried in the surface of the developing roller 3. Rubber applicable to the developing roller 3 is silicone rubber, butadien rubber, NBR (acrylonitrile-butadien rubber), hydrine rubber or EPDM (ethylene-propyrene-dien copolymer rubber) by way of example. Further, to stabilize quality against aging, it is preferable to cover the developing roller 3 with a coating material.

The developing roller 3 of the illustrative embodiment serves only to support the toner 6 thereon. That is, the developing roller 3 does not have to charge the toner 6 by friction as in the conventional developing device using a one-ingredient type developer. Therefore, the developing roller 3 should only satisfy required electric resistance, surface condition, hardness, and dimensional accuracy. It follows that a far broader range of substances than conventional is applicable to the developing roller 3.

The surface of the developing roller 3 should preferably be formed of a material chargeable to the same polarity as the toner 6, particularly fluorine-containing materials or so-called Teflon series. Materials belonging to the Teflon series feature low surface energy and desirable parting ability. Resins well known in the art include PTFE (polytetrafluoroethylene), PFA (tetrafluoroethylene-perfluoroalkylvinylether), FET (tetrafluoroethylene-hexafluoropropyrene copolymer), PCTFE (polychlorotrifluoroethylene), ETFE (tetrafluoroethylene-ethylene copolymer, ECTFE (chlorotrifuloroethylene-ethylene copolymer), PVDF (polyvinylidenefluoride) and PVF (polyvinylfluoride). To provide such a substance with conductivity, carbon black or similar conductive substance may be contained. Further, another resin may be added to the above substance in order to insure the even coating of the developing roller 3.

As for electric resistance, too, the bulk volume resistivity of the developing roller 3, including the coating layer, is selected to be $10^3$ Ω. cm to $10^8$ Ω. cm by adjusting the resistance of the base layer. The base layer in the illustrative embodiment has a volume resistivity of $10^2$ Ω. cm to $10^5$ Ω. cm, and therefore the surface layer may be provided with a slightly high volume resistivity.

The thickness of the coating layer of the developing roller 3 should preferably lie in the range of from 5 $\mu$m to 50 $\mu$m. A coating layer thicker than 50 $\mu$m would easily suffer from cracks and other defects due to stresses ascribable to a difference in hardness between it and the base layer. On the other hand, a coating layer thinner than 5 $\mu$m would easily wear and cause the base layer to be exposed to the outside, resulting in the deposition of the toner 6.

In the illustrative embodiment, the drum 1 and developer feed member 4 have diameters of 50 mm and 18 mm, respectively. The developing roller 3 has a diameter of 16 mm. The toner image formed on the drum 1 by the toner 6 is transferred to a paper sheet, and then the toner image is fixed on the paper sheet, although not shown specifically.

In the illustrative embodiment, the surface of the drum 1 has a coefficient of friction $\mu$ that is greater than 0.1, but smaller than 0.4. By lowering the coefficient of friction of the drum 1, it is possible to prevent the toner 6 from depositing on and contaminating the background of the drum 1. In addition, such a low coefficient of friction protects the surface of the drum 1 and thereby extends the service life of the drum 2.

The drum 1 is implemented by an organic or inorganic photoconductor and provided with the above range of surface coefficient $\mu$. To maintain the previously stated condition of the drum 2, Laid-Open Publication No. 4-372981 mentioned earlier teaches that when toner has a volume mean particle size of 4 μm to 10 μm, a substance capable of lowering the coefficient of friction of a photoconductive element is applied to the element, and that a lubricant may be directly applied to the element once for a preselected number of paper sheets or, alternatively, a member supporting a lubricant may be caused to contact the element either constantly or once for a preselected number of paper sheets.

Figure 2:
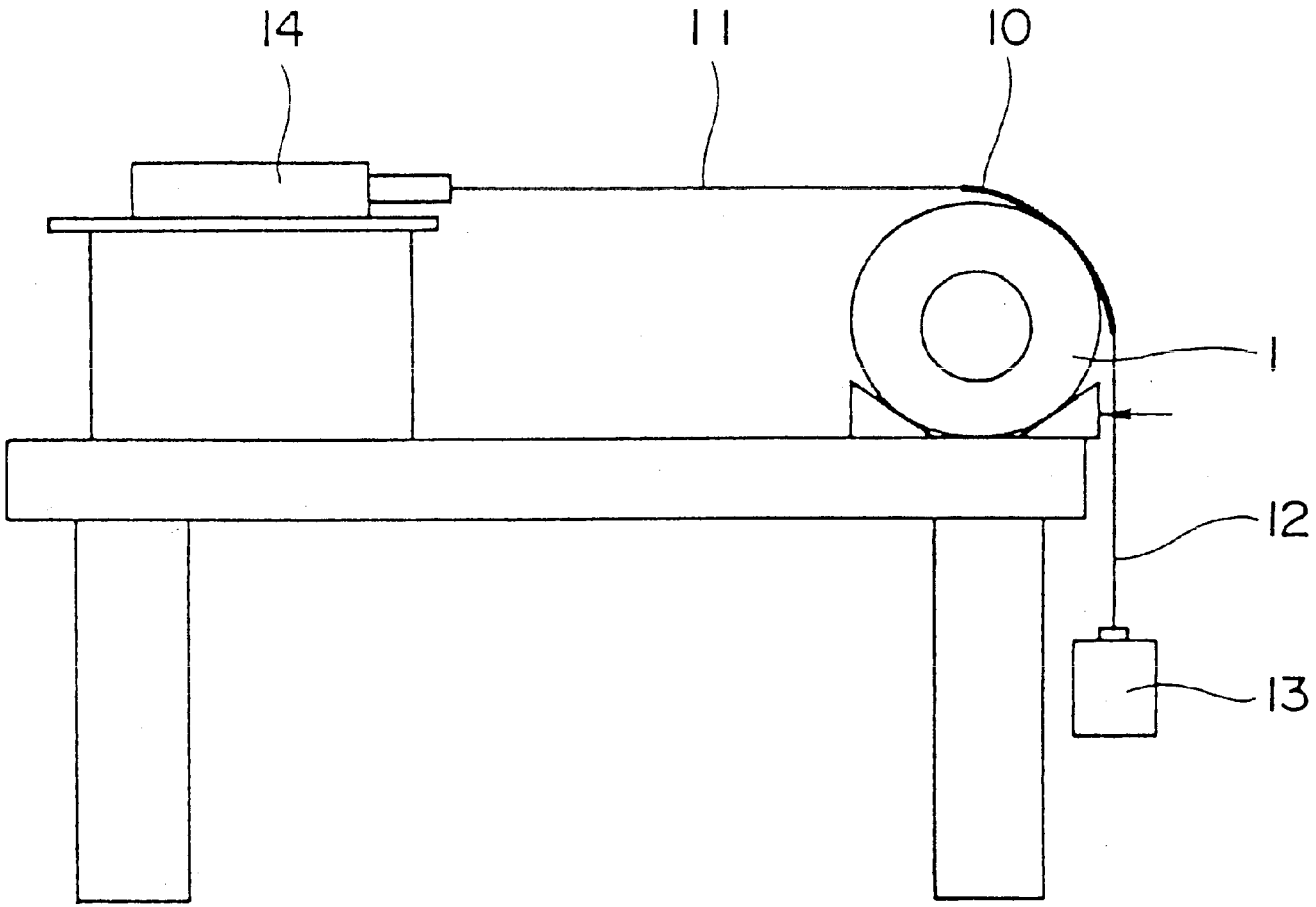
FIG. 2 is a view showing a specific arrangement for measuring the coefficient of friction of a photoconductive element included in the image forming apparatus.

A specific example of Euler's method available for the measurement of the coefficient of friction of a photoconductive element will be described with reference to FIG. 2. The coefficient of friction to be measured refers to the maximum static coefficient of friction. As shown, a sample piece of paper 10 is prepared by cutting a paper sheet type 6200 A4. T available from Ricoh Co., Ltd. into a piece sized 297 mm×30 mm. Threads 11 and 12 are affixed to opposite ends of the sample 10. The sample 10 has a weight of 71.7g/m$^2$, a thickness of 89 μm, a density of 0.81 g/cm$^3$, a smoothness of 40 s on the front and 37 s on the rear, a volume resistance of 1.2E+11 α.cm, a coefficient of friction of 0.64 (vertical) and 0.65 (horizontal) on both sides in terms of tan θ (weight with rubber).

After the sample 10 has been laid on the drum 1, a weight 13 that is 0.98 N (100 g) heavy is attached to one end of the sample 10. In this condition, the other end of the sample 10 is pulled by a digital push-pull gauge 14 so as to read the value of the gauge when the sample 10 begins to move. Assuming that the value read is F (N), then the coefficient of friction μ is expressed as:

$$\mu=[1n(F/0.98)]/(/2)$$

The drum 1 without the application of the lubricant had a coefficient of friction μ, as measured by the above-described method, ranging from 0.4 to 0.6 and sequentially increased with the elapse of time. By contrast, the drum 1 with the application of the lubricant had a coefficient of friction μ of 0.1 to 0.4.

The drum 1 and developing roller 3 contact each other with the intermediary of the toner layer deposited on the roller 3. For this purpose, use should preferably be made of a spring, particularly a plurality of springs, in order to reduce irregular contact between the drum 1 and the developing roller 3. The springs may be implemented by coil springs or leaf springs by way of example. Assuming that the developing roller 3 has a hardness of 30° in terms of JIS A scale by way of example, then the roller should preferably contact the drum 1 with a linear pressure of 1 gf/mm to 16 gf/mm. The number of springs or biasing means should be as great as possible for reducing irregular contact.

FIG. 3 is a table showing a relation between the above contact pressure and the developing characteristic (uniformity of a solid image and background contamination) determined by a series of experiments. In the table, letters a, b and c are representative of banding, the omission of a leading edge, and a non-uniform solid image, respectively. The linear velocity ratio of the developing roller 3 to the drum 1 was selected to be 1.2. As shown, when the coefficient of friction μ was smaller than or equal to 0.1, the scavenging ability of the developing roller 3 increased and prevented the toner 6 from being sufficiently transferred form the roller 3 to the drum 1. The resulting toner image was low in density and therefore in quality.

When the coefficient of friction p was greater than or equal to 0.4, the background of the drum 1 was easily contaminated. To solve this problem, the contact pressure of the developing roller 3 to act on the drum 1 or the linear velocity ratio of the roller 3 to the drum 1 may be increased. This, however, aggravates banding and other defects.

Further, the developing roller 3 having a hardness of 45° or less, as stated earlier, can evenly contact the drum 1 and insure a uniform image. This advantage available with the illustrative embodiment will be described specifically with reference to FIG. 4. A relation shown in FIG. 4 was also determined under the above-described basic conditions except that the hardness HS of the developing roller 3 was confined in a range of 10°≦HS ≦45° (JIS A scale).

In the illustrative embodiment, the developing roller 3 contacts the drum 1 with the intermediary of the toner layer. It is therefore necessary to provide the developing roller 3 with a smooth surface, so that a uniform image can be achieved.

It is extremely difficult to mold a developing roller whose hardness is lower than 10° with high dimensional accuracy because such a roller easily contracts or expands during molding. While the base layer of a developing roller may contain oil for making the roller soft, the oil oozes out when the roller is repeatedly operated under the action of pressure. The oil therefore contaminates toner deposited on the developing roller and degrades the developing ability to a critical degree, as determined by experiments. On the other hand, a developing roller whose hardness is higher than 45° can be molded with accuracy and needs a minimum of oil, so that the above toner suffers from a minimum of contamination ascribable to the oil. However, considering the allowable range of contact pressure, the adequate range of the amount of bite is extremely limited. It is therefore necessary to select the contact pressure of the developing roller 3 to act on the drum 1 with extreme accuracy.

Assume a developing roller A whose hardness is 50°, which does not lie in the range unique to the illustrative embodiment, and a developing roller B whose hardness is 20° lying in the above range. Then, the developing rollers A and B differ from each other in the difficulty of fabrication and therefore in accuracy, i.e., the deviation width of the diameter with respect to the center.

Specifically, when the developing roller A had a diameter of 16 mm, the deviation of the diameter with respect to the center was as small as 0.05 mm, i.e., 0.025 mm at each side in terms of the amount of bite. However, for the same diameter, the deviation of the developing roller B was as great as 0.1 mm, i.e., 0.05 mm at each side in terms of the amount of bite. The developing roller B would therefore fail to effect contact development at some part thereof and would contact the drum 1 more strongly than expected at another part thereof.

Figure 4:
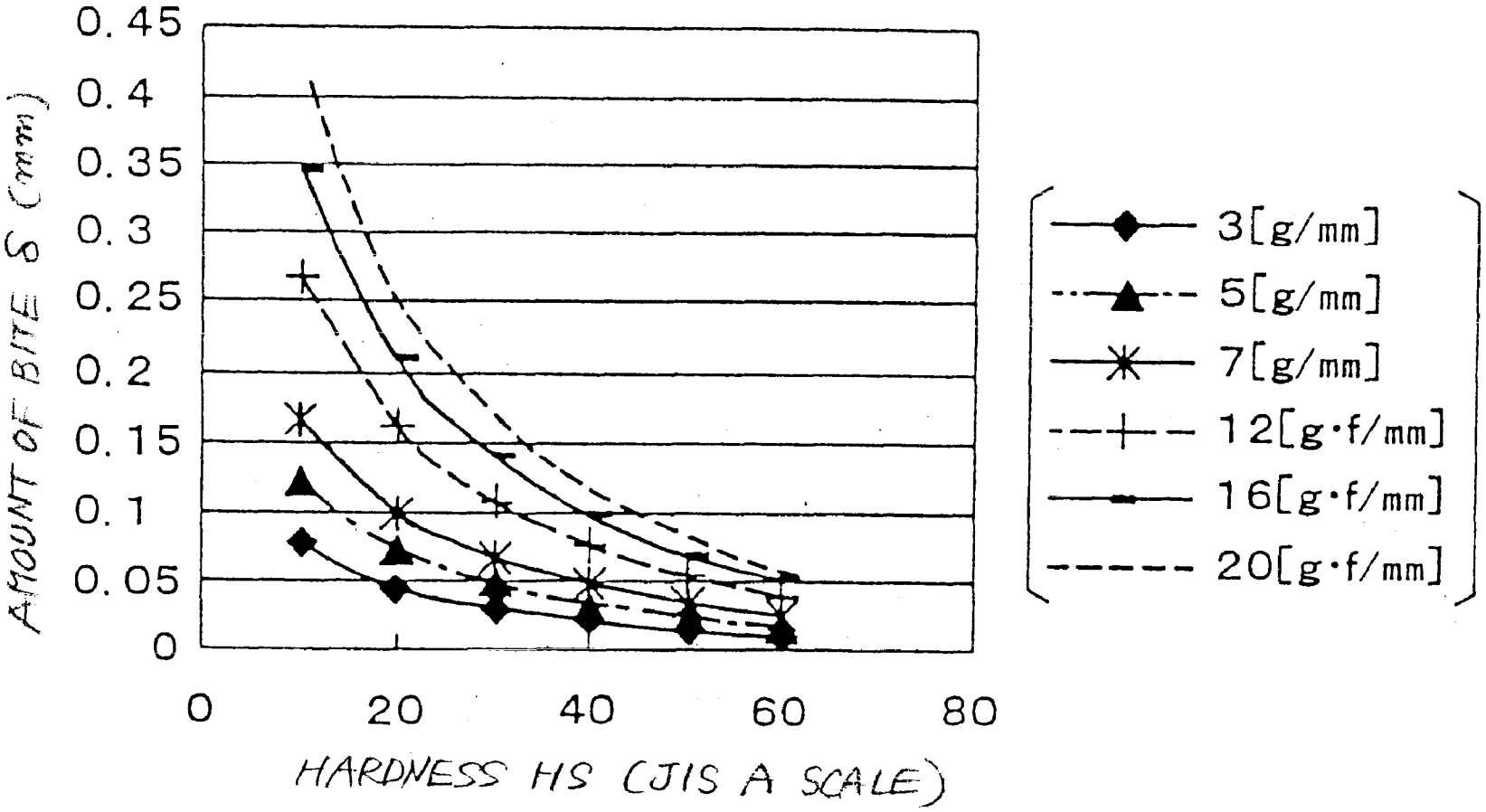
FIG. 4 is a graph showing a relation between the hardness of the developing roller and the amount of bite of the roller into the photoconductive element.

FIG. 4 shows a relation between the hardness of the developing roller 3 and the amount of bite of the same into the drum 1 by using the contact pressure as a parameter. Considering the above-described deviation width of the diameter of the developing roller, the developing roller A has a value between 3 g/mm and 12 g/mm while the developing roller has a value between 3 g/mm and 7 g/mm. The developing roller B therefore exerts a scavenging effect due to non-contact and excessive contact and thereby obstructs development to a noticeable degree. By contrast, the developing roller A insures a uniform developing characteristic.

The illustrative embodiment is practicable not only with a two-ingredient type developer shown and described, but also with a one-ingredient type developer.

In summary, in accordance with the present invention, a developing roller or toner support member has a surface that is chargeable to the same polarity as toner. The toner support member therefore serves to simply support the toner without electrostatically effecting the toner. It follows that the development of a latent image is free from the influence of the static electricity of the toner support member, enhancing image quality.

Further, a photoconductive element has a coefficient of friction $\mu$ confined in the range of $0.1<\mu<0.4$. This prevents the toner from depositing on and contaminating the background area of the photoconductive element. In addition, the surface of the photoconductive element is protected and has its service life extended.

Moreover, the toner support member has a hardness HS lying in the range of $10° \leqq HS \leqq 45°$ (JIS A scale). This provides the toner support member with a smooth surface and thereby insures a uniform developing characteristic.

Various modifications will become possible for those skilled in the art after receiving the teachings of the present disclosure without departing from the scope thereof.

What is claimed is:

1. In an image forming apparatus for feeding a two-ingredient type developer and causing toner that is electrically fed to selectively deposit on a toner support member to thereby develop a latent image formed on a photoconductive element, said toner support member supporting the toner without electrostatistically effecting the toner and having at least a surface layer thereof formed of a material chargeable to a same polarity as said toner.

2. An image forming apparatus comprising:

a toner support member on which toner is deposited for developing a latent image formed on a photoconductive element from deposited toner from a developer, said toner support member supporting the toner without electrostatistically effecting the toner and including at least a surface layer formed of a material chargeable to a same polarity as the toner, and having a hardness HS in a range of $10° \leqq HS \leqq 45°$, by JIS-A scale.

3. An image forming apparatus according to claim 2, wherein said surface layer of said toner support member contains a fluorine-containing substance.

4. An image forming apparatus according to claim 3, wherein the developer is a two-ingredient developer.

5. An apparatus as claimed in claim 4, wherein said photoconductive element has a static coefficient of friction $\mu$ with respect to paper lying in a range of $0.1<\mu<0.4$.

6. An image forming apparatus according to claim 3, wherein the developer is a one-ingredient developer.

7. An apparatus as claimed in claim 6, wherein said photoconductive element has a static coefficient of friction $\mu$ with respect to paper lying in a range of $0.1<\mu<0.4$.

8. An apparatus as claimed in claim 3, wherein said photoconductive element has a static coefficient of friction $\mu$ with respect to paper lying in a range of $0.1<\mu<0.4$.

9. An image forming apparatus according to claim 2, wherein the developer is a two-ingredient developer.

10. An apparatus as claimed in claim 9, wherein said photoconductive element has a static coefficient of friction , with respect to paper lying in a range of $0.1<\mu<0.4$.

11. An image forming apparatus according to claim 2, wherein the developer is a one-ingredient developer.

12. An apparatus as claimed in claim 11, wherein said photoconductive element has a static coefficient of friction $\mu$ with respect to paper lying in a range of $0.1<\mu<0.4$.

13. An apparatus as claimed in claim 2, wherein said photoconductive element has a static coefficient of friction $\mu$ with respect to paper lying in a range of $0.1<\mu<0.4$.

14. A toner support member for use in an image forming apparatus, on which toner is deposited for developing a latent image formed on a photoconductive element from deposited toner from a developer, said toner support member supporting the toner without electrostatistically effecting the toner and comprising:

at least a surface layer formed of a material changeable to a same polarity as the toner, and having a hardness HS in a range of $10° \leqq HS \leqq 45°$, by JIS-A scale.

15. A toner support member according to claim 14, wherein said surface layer of said toner support member contains a fluorine-containing substance.

16. A toner support member according to claim 15, wherein the developer is a two-ingredient developer.

17. An apparatus as claimed in claim 16, wherein said photoconductive element has a static coefficient of friction $\mu$ with respect to paper lying in a range of $0.1<\mu<0.4$.

18. A toner support member according to claim 15, wherein the developer is a one-ingredient developer.

19. An apparatus as claimed in claim 18, wherein said photoconductive element has a static coefficient of friction $\mu$ with respect to paper lying in a range of $0.1<\mu<0.4$.

20. An apparatus as claimed in claim 15, wherein said photoconductive element has a static coefficient of friction $\mu$ with respect to paper lying in a range of $0.1<\mu<0.4$.

21. A toner support member according to claim 14, wherein the developer is a two-ingredient developer.

22. An apparatus as claimed in claim 21, wherein said photoconductive element has a static coefficient of friction $\mu$ with respect to paper lying in a range of $0.1<\mu<0.4$.

23. A toner support member according to claim 14, wherein the developer is a one-ingredient developer.

24. An apparatus as claimed in claim 23, wherein said photoconductive element has a static coefficient of friction $\mu$ with respect to paper lying in a range of $0.1<\mu<0.4$.

25. An apparatus as claimed in claim 14, wherein said photoconductive element has a static coefficient of friction $\mu$ with respect to paper lying in a range of $0.1<\mu<0.4$.

* * * * *